US007467609B2

(12) United States Patent
Naumann

(10) Patent No.: US 7,467,609 B2
(45) Date of Patent: Dec. 23, 2008

(54) VALVE-STROKE CONTROLS

(75) Inventor: Herbert Naumann, Elmshorn (DE)

(73) Assignee: ThyssenKrupp Presta TecCenter AG, Eschen (LI)

( * ) Notice: Subject to any disclaimer, the term of this patent is extended or adjusted under 35 U.S.C. 154(b) by 451 days.

(21) Appl. No.: 10/834,599

(22) Filed: Apr. 29, 2004

(65) Prior Publication Data

US 2004/0226525 A1 Nov. 18, 2004

Related U.S. Application Data

(63) Continuation of application No. PCT/EP02/11936, filed on Oct. 25, 2002.

(30) Foreign Application Priority Data

Nov. 6, 2001 (DE) ..... 101 55 007

(51) Int. Cl.
*F01L 1/34* (2006.01)

(52) U.S. Cl. ..... 123/90.16; 123/90.39; 123/90.44; 74/569

(58) Field of Classification Search ..... 123/90.16, 123/90.2, 90.39, 90.44, 90.41; 74/559, 567, 74/569

See application file for complete search history.

(56) References Cited

U.S. PATENT DOCUMENTS

| | | | | |
|---|---|---|---|---|
| 6,439,177 | B2 * | 8/2002 | Pierik | 123/90.16 |
| 6,886,512 | B2 * | 5/2005 | Naumann | 123/90.39 |
| 6,973,904 | B2 * | 12/2005 | Naumann | 123/90.39 |
| 7,111,600 | B2 * | 9/2006 | Naumann | 123/90.39 |

FOREIGN PATENT DOCUMENTS

| | | | |
|---|---|---|---|
| DE | 10100173 | A1 * | 7/2002 |
| EP | 1072762 | A2 * | 1/2001 |

* cited by examiner

*Primary Examiner*—Ching Chang
(74) *Attorney, Agent, or Firm*—Crowell & Moring LLP

(57) ABSTRACT

A valve-stroke control apparatus continuously varies the stroke of a valve in an engine, and selectively maintains it in a closed position, while the-engine is in operation. The control apparatus includes a force-transmitting rod which is pivoted by a cam and a cam-contact roller. An additional roller on one end of said force-transmitting rod engages a transverse contact surface of a stroke-length setting lever. The contact surface has a contour such that pivoting of the force-transmitting rod causes movement between the contact surface and the additional roller, which in turn displaces the force-transmitting rod longitudinally in a direction associated with valve opening. Such displacement is introduced by way of a rotary articulation into a rocking lever that activates the valve.

3 Claims, 6 Drawing Sheets

VALVE-STROKE CONTROLS

CROSS REFERENCE TO RELATED APPLICATIONS

This application is a continuation under 35 U.S.C. §120 and 365(c) of International Patent Application PCT/EP02/11936, filed Oct. 25, 2002 and which designed the United States of America, and claims priority of German patent document 101 55 007.3, filed Nov. 6, 2001.

The present invention concerns mechanical controls in a motor vehicle that, while the vehicle is in operation, continuously vary the lengths of strokes traveled by a valve or group of valves between a maximum, the valve being completely open, and zero, the valve remaining completely closed, whereby the valve remains open more and more briefly as the length of the stroke decreases. The valves are activated either by rocking levers, cartridge-shaped tappets, or force-transmitting rods or, desmodromically, by tie rods that transmit tension and compression and are themselves subject to rocking levers, elbow levers, or force-transmitting rods.

The object of the present invention is small and compact mechanical valve-stroke controls that can carry out the aforesaid functions.

Since these valve-stroke controls can maintain a valve constantly closed, they can be employed to adjust for load without involving chokes and to disengage valves and cylinders.

One or more valves can be alternatively activated by these controls by way of various types of cam, in which event the setting can be selected without shifting any coupling bolts.

FIG. 1 illustrates valve-stroke controls wherein a valve is activated by a rocking lever by way of a rotary articulation, the rocking lever being driven by an elbow lever that is provided with contact surfaces that engage a roller accommodated in a stroke-length setting lever.

FIG. 2 illustrates valve-stroke controls wherein a valve is activated by a cartridge-shaped tappet that is itself activated by a force-transmitting rod by way of a rotary articulation, whereby the force-transmitting rod engages, by way of contact surfaces, a roller accommodated in a stroke-length setting lever, FIG. 3 illustrates valve-stroke controls wherein a valve is activated by a rocking lever that is itself activated by a force transmitting rod by way of a rotary articulation, whereby the force-transmitting rod is activated by way of the engagement of a roller with the contact surfaces of a stroke-length setting lever.

Figure 1:
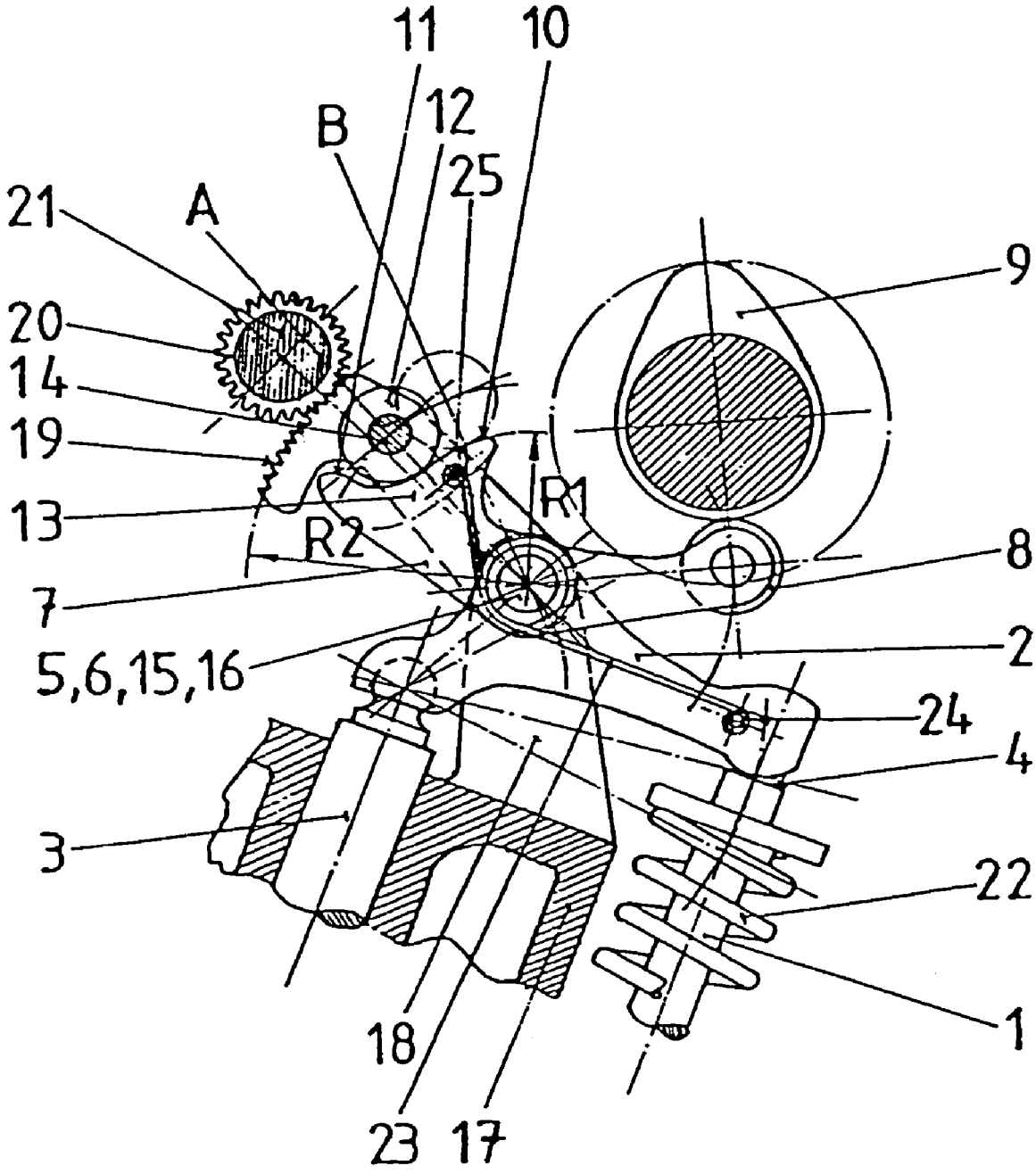
FIG. 1 illustrates valve-stroke controls mounted on a cylinder head and employed while a vehicle is in operation to continuously vary the length of the stroke traveled by a valve 1 or to maintain the valve constantly closed. Such controls can be employed to handle several such valves simultaneously instead of just one.

Valve 1 is activated by a rocking lever 2. Rocking lever 2 is provided with a valve-play compensator 3 and a surface 4 that drives the valve. Between valve-play compensator 3 and surface 4 is a rotary articulation 5. Extending through rotary articulation 5 is an axial bolt 6. Rotary articulation 5 drives rocking lever 2 from above by way of an elbow lever 7. Elbow lever 7 is driven by a cam-contacting roller 8 at one end. Cam-contacting roller 8 itself is subject to a cam 9. At its other end, elbow lever 7 engages, by way of contact surfaces 10 and 11 approximately perpendicular to its longitudinal axis, a roller 12 mounted on a stroke-length setting lever 13 that accommodates rocking lever 2 and elbow lever 7. The rotary articulation 5 and bolt 6 that elbow lever 7 pivots around is located between contact surfaces 10 and 11 and cam-contacting roller 8. The roller 12 mounted on stroke length setting lever 13 is provided with an axial bolt 14 accommodated in the upper end of stroke-length setting lever 13. Stroke-length setting lever 13 is secured by rotary articulations 15 and axial bolts 16 in its lower end in holders 18 fastened to a cylinder head 17. The axis of rotation of rotary articulations 15 simultaneously that of the shared rotary articulation 5 that rocking lever 2 and elbow lever 7 pivot around while valve 1 is closed. The contact surface 10 of elbow lever 7 curves outward in a circular arc. The radius R1 of contact surface 10 extends out of a center constituted by the axis of rotation of the rotary articulation 5 associated with elbow lever 7. Valve 1 can accordingly be maintained closed in that the section of the shaft of elbow lever 7 between contact surfaces 10 and 11 and rotary articulation 5 is not displaced longitudinally as long as the contact surface 10 of elbow lever 7 is engaging the roller 12 on stroke-length setting lever 13 while elbow lever 7 is rotating. The contact surface 11 of elbow lever 7 is provided with an inward curvature that extends beyond contact surface 10. As elbow lever 7 rotates, accordingly, its contact surface 11 engaging the roller 12 mounted on stroke-length setting lever 13, the section of elbow lever 7 between contact surfaces 10 and 11 and rotary articulation 5 is displaced longitudinally, and rocking lever 2, driven by way of rotary articulation 5, will activate valve 1.

In order to fulfill its function, stroke-length setting lever 13 is provided with a cogged circular segment 19 of radius R2 of arc that curves around the axis of rotation represented by a rotary articulation 15. Cogged segment 19 is engaged by a cogwheel 20 mounted on a transmission shaft 21. To avoid the play that sometimes occurs between the flanks of the cogs in such mechanisms, it is possible to employ two mutually engaging cogwheels, one mounted tight on transmission shaft 21 and the other rotating around it and secured by a helical spring, resulting in opposing engagement.

In position A, stroke-length setting lever 13 establishes a maximal-length stroke and, in position B, maintains valve 1 closed.

When, during the rotation of elbow lever 7, stroke-length setting lever 13 shifts out of the position wherein it maintains valve 1 closed and into the position wherein it establishes the maximal length stroke, the contact surface 11 of elbow lever 7 will begin to engage the roller 12 mounted on stroke-length setting lever 13 over a short distance, and the lever will accordingly establish a short stroke that will briefly open the valve. As contact surface 11 further increases its engagement with roller 12, the stroke will continuously lengthen, with the length of time it remains open simultaneously increasing.

Valve 1 is also subject to the force of a helical spring 22. Since, during the establishment of a short stroke with valve 1 maintained closed, spring 22 cannot exert enough force on elbow lever 7 to force cam-contacting roller 8 against cam 9, two spiral springs 23 are provided, one on each side of rocking lever 2 and elbow lever 7 with their coils extending through the bolt 6 in rotary articulation 5 and with one face engaging counterbearings 24 mounted on rocking lever 2 and the other engaging counterbearings 25 mounted on elbow lever 7.

One valve 1 can be activated by a solid rocking lever 2, with the upper elbow lever 7 composed of two halves provided with bores to accommodate the bolts 6 in rotary articulation 5 and the axis of cam-contacting roller 8. To facilitate assembly, the bolt 6 extending through the bores in elbow lever 7 can engage a bearing shell half on rocking lever 2.

Figure 2:
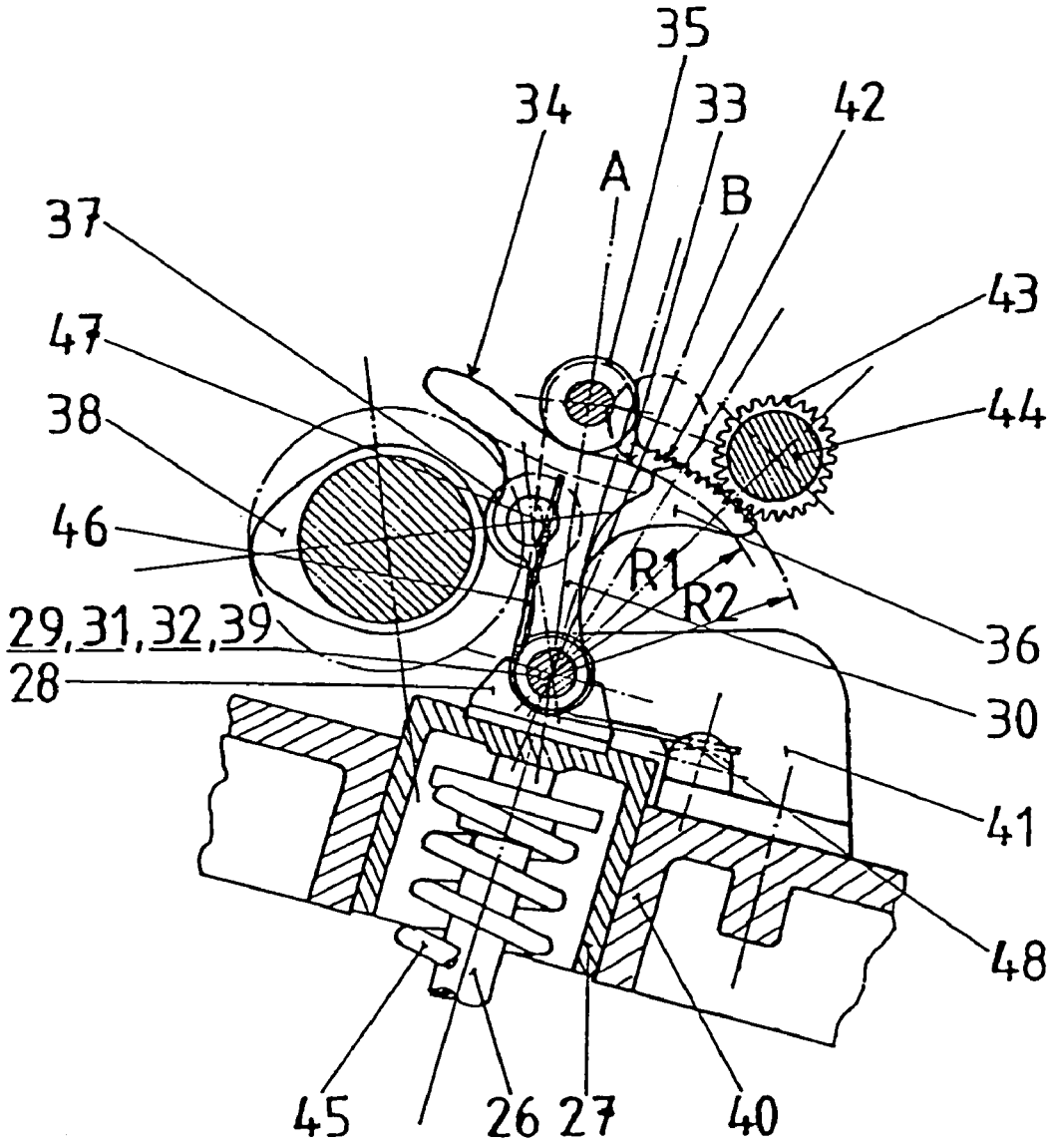

FIG. 2 illustrates valve-stroke controls accommodated in the cylinder head of a motor vehicle that, while the vehicle is in operation, continuously vary the lengths of strokes traveled by a valve or between a maximum, the valve being completely open, and zero, the valve remaining completely closed.

A valve 26 is activated by way of a cartridge-shaped tappet 27, which can also act as a valve-play compensator. Mounted on the base of tappet 27 is a bearing block 28 that accommodates a bearing-shell half 29. Bearing-shell half 29 is engaged by an axial bolt 31 accommodated at the lower end of a force transmitting rod 30, creating an assembly-facilitating rotary articulation 32. At its upper end, force-transmitting rod 30 is provided with contact surfaces 33 and 34 that extend more or less perpendicular to its longitudinal axis. Contact surfaces 33 and 34 engage a roller 35 mounted on a stroke-length setting lever 36 that extends around force-transmitting rod 30. Between its ends, force-transmitting rod 30 is provided with a cam-contacting roller 37 by way of which the rotation of force-transmitting rod 30 can be initiated by a cam 38. Stroke-length setting lever 36, which is provided at its upper end with roller 35, is accommodated at its lower end in rotary articulations 39 accommodated in turn in holders 41 fastened to a cylinder head 40. The axis of rotation of rotary articulations 39 is simultaneously that of the shared rotary articulation 32 for bearing block 28 and force-transmitting rod 30 as long as valve 26 remains closed. The contact surface 33 of force-transmitting rod 30 curves outward in a circular arc, and its radius R1 extends out from a center constituted by the axis of rotation of the rotary articulation 32 associated with force transmitting rod 30. Consequently, valve 26 will be maintained closed in that force-transmitting rod 30 cannot longitudinally displaced as long as contact surface 33 engages the roller 35 mounted on stroke-length setting lever 36 while force-transmitting rod 30 is pivoting. The contact surface 34 of stroke-length setting lever 36 is provided with an inward curvature that extends beyond contact surface 33. Accordingly, as force-transmitting rod 30 pivots, its contact surface 34 will engage the roller 35 mounted on stroke-length setting lever 36, force-transmitting rod 30 will be longitudinally displaced, and tappet 27, driven by way of rotary articulation 32, will activate valve 26.

Stroke-length setting lever 36 is provided with a cogged segment 42 in the form of a circular arc that extends around the axis of rotation of its rotary articulations 39. The arc has a radius R2. Cogged segment 42 is engaged by a cogwheel 43 mounted on a camshaft 44.

In position A, stroke-length setting lever 36 establishes a maximal-length stroke and, in position B, maintains valve 1 closed.

When, during the pivoting motion of force-transmitting rod 30, stroke-length setting lever 36 shifts out of the position wherein valve 26 is maintained closed and into the position wherein a maximal-length stroke is established, the contact surface 34 of force-transmitting rod 30 will begin to engage the roller 35 mounted on stroke-length setting lever 36 over a short distance, and the lever will accordingly establish a short stroke that will briefly open the valve. As contact surface 34 further increases its engagement with roller 35, the stroke will continuously lengthen, with the length of time it remains open simultaneously increasing continuously.

A spring 45 is accommodated inside tappet 27. Spring 45 forces the tappet against cam-contacting roller 37 and hence cam-contacting roller 37 against cam 38. During the establishment of a short valve stroke, with valve 26 maintained closed, however, spring 45 will not be able to exert enough force on the tappet to force the cam-contacting roller against the cam. For this event, two spiral springs 46 are provided, one on each side of force-transmitting rod 30, with their coils extending through the bolt 31 in rotary articulation 32 and with one face engaging counterbearings 47 mounted on force-transmitting rod 30 and the other engaging counterbearings 48 mounted on holders 41 fastened to a cylinder head 40 that accommodate the rotary articulations 39 in stroke length setting lever 36.

When tappet 27 does not simultaneously compensate for the play between itself and bearing block 28, either a setting disk can be provided or the vertical dimension of cam 38 can be longer.

Figure 3:
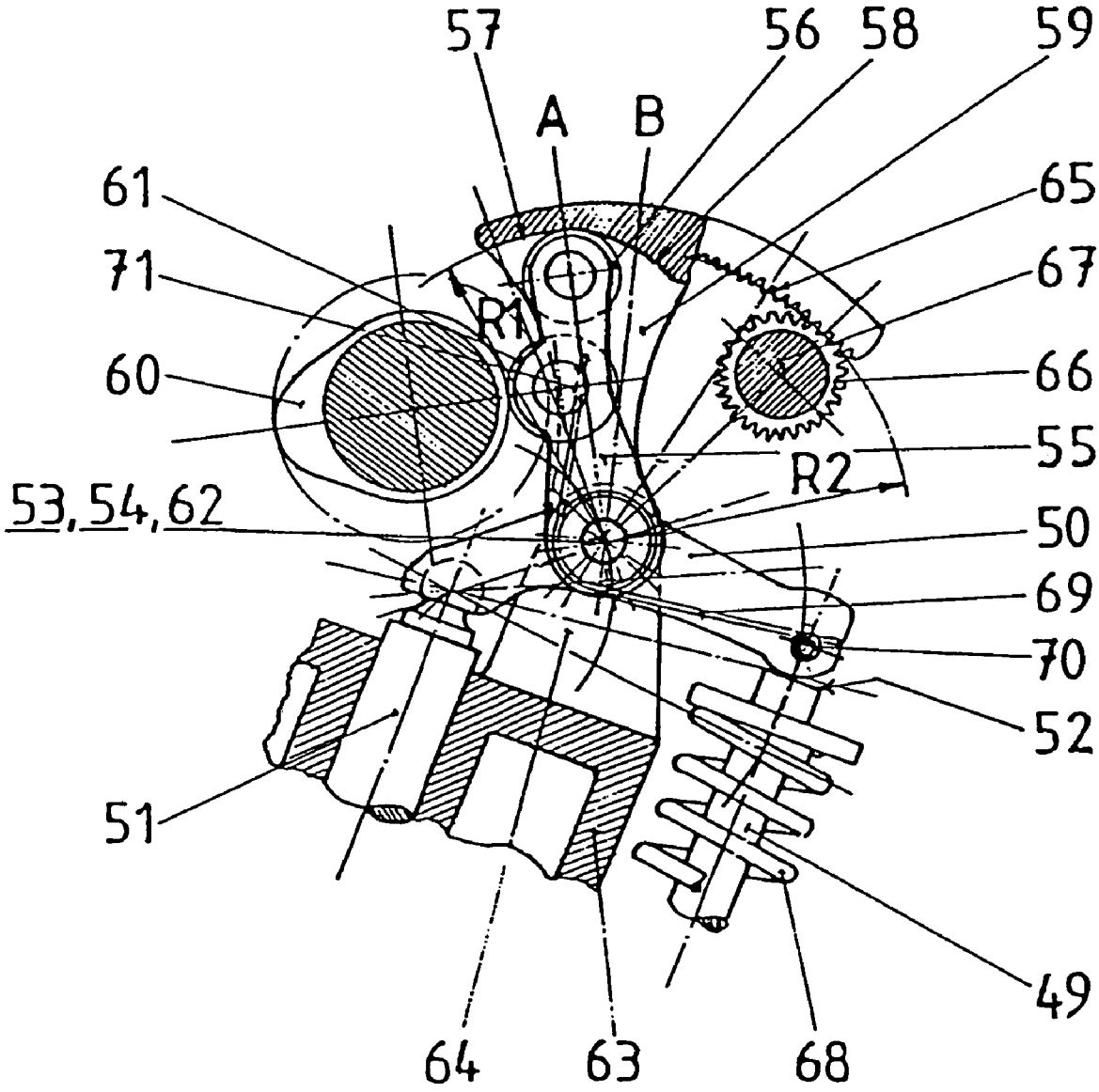

FIG. 3 illustrates valve-stroke controls accommodated in the cylinder head of a motor vehicle that, while the vehicle is in operation, continuously vary the lengths of strokes traveled by a valve 49 or group of valves 49 between a maximum, the valve being completely open, and zero, the valve remaining completely closed.

A rocking lever 50 that activates a valve 49 is provided, between a bearing in the form of a valve-play compensator 51 and the valve's force-subject face 52, with a rotary articulation 53. Extending through rotary articulation 53 is an axial bolt 54 that drives rocking lever 50 along with the lower end of a force transmitting rod 55. The upper end of force-transmitting rod 55 is provided with a roller 56. Roller 56 engages the contact surfaces 57 and 58 of a stroke-length setting lever 59. Stroke-length setting lever 59 includes rocking lever 50 and force-transmitting rod 55. Contact surfaces 57 and 58 extend more or less perpendicular to the longitudinal axis of stroke-length setting lever 59. Force-transmitting rod 55 is driven by a cam 60 by way of a cam-contacting roller 61 accommodated between the rod's two ends. Stroke-length setting lever 59 is, along with its contact surfaces 57 and 58, accommodated at its lower end in rotary articulations 62 that are accommodated in turn in holders 64 fastened to a cylinder head 63. The axis of rotation of rotary articulations 62 simultaneously constitutes the axis of rotation of a rotary articulation 53 shared by rocking lever 50 and force transmitting rod 55 while the valve is closed. The contact surface 57 of stroke-length setting lever 59 curves inward along the arc of a circle. The radius R1 of contact surface 57 extends out of the centers of the rotary articulations 62 associated with stroke length setting lever 59. Valve 49 can accordingly be maintained closed in that force-transmitting rod 55 cannot be displaced longitudinally as long as the roller 56 mounted thereon cannot engage the contact surface 58 of stroke-length setting lever 59 while force-transmitting rod 55 is pivoting. The contact surface 58 of stroke-length setting lever 59 curves inward extending beyond contact surface 57. As force-transmitting rod 55 pivots, accordingly, the engagement of its roller 56 with the contact surface 58 of stroke-length setting lever 59 will displace force transmitting rod 55 linearly, and rocking lever 50, driven by rotary articulation 53, will activate valve 49.

To allow stroke-length setting lever 59 to carry out its function, it is provided with a cogged segment 65 in the form of a circular arc extending around its rotary articulations 62 and with a radius R2. Cogged segment 65 is engaged by a cogwheel 66 mounted on a camshaft 67.

In position A, stroke-length setting lever 59 establishes a maximal-length stroke and, in position B, maintains valve 49 closed.

When, during the pivoting motion of force-transmitting rod 55, stroke-length setting lever 59 shifts out of the position wherein it maintains valve 49 closed, the roller 56 mounted on force transmitting rod 55 will begin over a short distance to engage the contact surface 58 of stroke-length setting lever 59, opening the valve briefly and over a short stroke. Consequently, as roller 56 increasingly engages contact surface 58, the length of the stroke will increase continuously along with the length of time the valve will remain open.

During the establishment of a short valve stroke, with valve 49 maintained closed, however, spring 68 will not be able to exert enough force on force-transmitting rod 55 to force cam-contacting roller 61 against cam 60. For this event, two spiral springs 69 are provided, one on each side of rocking lever 50 and force transmitting rod 55, with their coils extending through the bolt 54 in rotary articulation 53 and with one face engaging counterbearings 70 mounted on rocking lever 50 and the other engaging counterbearings 71 mounted on force-transmitting rod 55.

One valve 49 can be activated by a solid rocking lever 50, with force-transmitting rod 55 composed of two halves provided with bores to accommodate the bolts 54 in rotary articulation 53, with bores for the shaft of roller 56, and with bores for the shaft of roller 61. To facilitate assembly, the bolt 54 extending through the bores in force-transmitting rod 55 can engage a bearing shell half on rocking lever 50.

Figure 4:
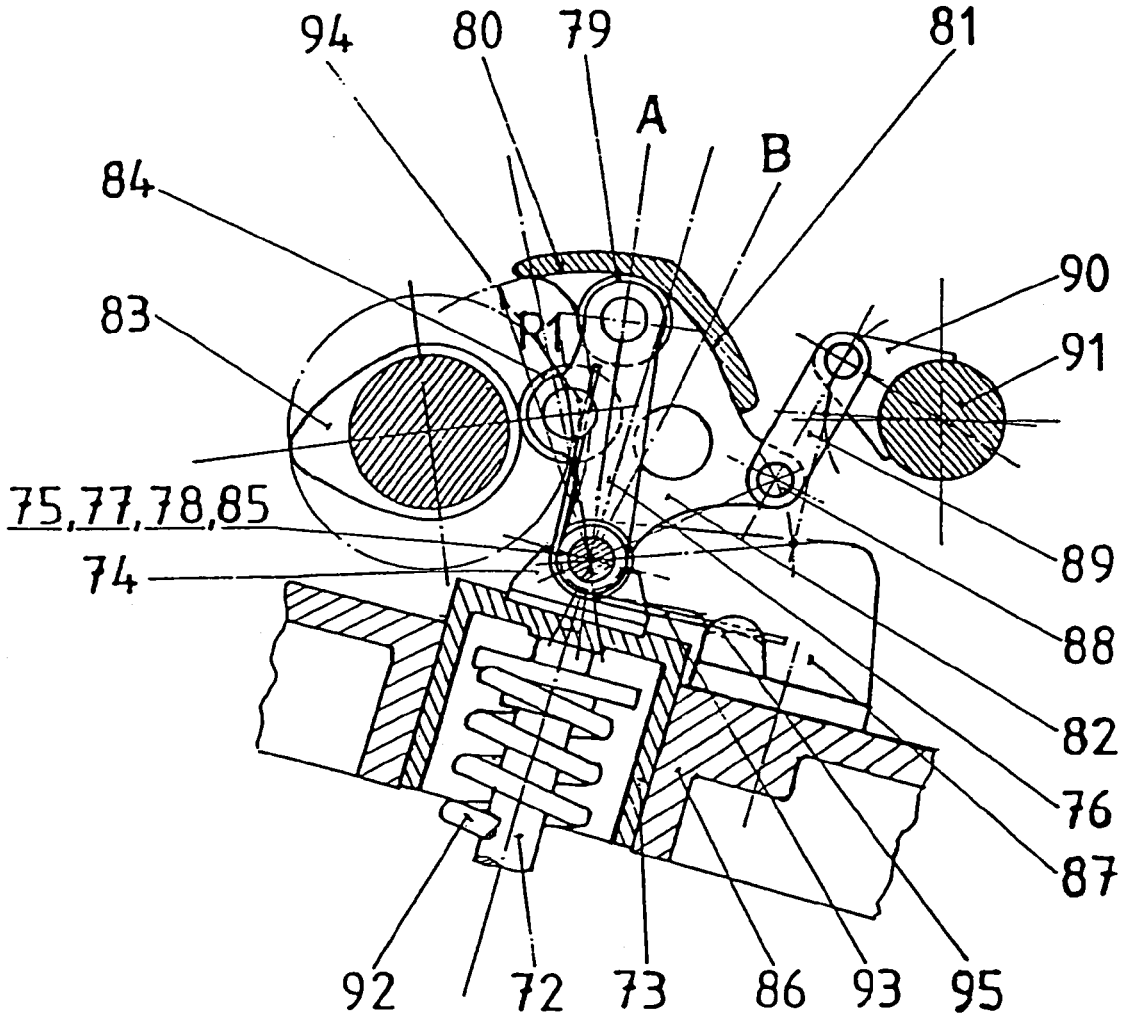
FIG. 4 illustrates valve-stroke controls with a valve activated by a cartridge-shaped tappet that is itself activated by a force transmitting rod by way of a rotary articulation, whereby the force-transmitting rod is activated by way of the engagement of a roller with the contact surfaces of a stroke-length setting lever.

FIG. 4 illustrates valve-stroke controls mounted in a cylinder head and employed while a vehicle is in operation to continuously vary the length of the stroke traveled by a valve 72 or to maintain the valve constantly closed.

Valve 72 is activated by a cartridge-shaped tappet 73, which can also act as a valve-play compensator. Mounted on the upper surface is a bearing block 74. Bearing block 74 accommodates a bearing shell half 75. Bearing shell half 75 is engaged by an axial bolt 77 mounted on the lower end of a force-transmitting rod 76, creating a rotary articulation 78 that simplifies assembly. At its upper end, force-transmitting rod 76 is provided with a roller 79 that engages the contact surfaces 80 and 81 of a stroke-length setting lever 82 that includes force-transmitting rod 76. Contact surfaces 80 and 81 extend more or less perpendicular to the longitudinal axis of stroke-length setting lever 82. Force transmitting rod 76 itself is driven by a cam 83 by way of a cam contacting roller 84 between its two ends.

Stroke-length setting lever 82, which is provided at its upper end with contact surfaces 80 and 81, is accommodated at its lower end in rotary articulations 85 accommodated in turn in holders 87 fastened to a cylinder head 86.

The axis of rotation of rotary articulations 85 simultaneously constitutes that of the shared rotary articulation 78 that bearing block 74 and force-transmitting rod 76 pivot around while valve 72 is closed. The contact surface 80 of stroke-length setting lever 59 curves inward along the arc of a circle. The radius R1 of contact surface 80 extends out of the center of the rotary articulation 85 associated with stroke-length setting lever 82. Valve 72 can accordingly be maintained closed in that force transmitting rod 76 cannot be displaced longitudinally as long as the roller 79 mounted thereon cannot engage the contact surface 80 of stroke-length setting lever 82 while force-transmitting rod 76 is pivoting. The contact surface 81 of stroke-length setting lever 82 is provided with an inward curvature that extends beyond contact surface 80. As force-transmitting rod 76 rotates, accordingly, its roller 79 engaging the contact surface 81 of stroke-length setting lever 82, force-transmitting rod 76 will be displaced longitudinally, and cartridge-shaped tappet 73 will activate valve 72 by way of rotary articulation 78.

In order to fulfill its function, stroke-length setting lever 82 is provided with a rotary articulation 88 with a link 89. Link 89 is driven by a lever arm 90 mounted on a rotating shaft 91.

In position A, stroke-length setting lever 82 establishes a maximal-length stroke and, in position B, maintains valve 72 closed.

When, during the rotation of force-transmitting rod 76, stroke length setting lever 82 shifts out of the position wherein it maintains valve 72 closed and into the position wherein it establishes the maximal-length stroke, the roller 79 mounted on force-transmitting rod 76 will begin to engage the contact surface 81 of stroke-length setting lever 82 over a short distance, establishing a short stroke that will briefly open the valve. As roller 79 further continuously increases its engagement with contact surface 81, the stroke will simultaneously continuously lengthen, with the length of time it remains open simultaneously increasing.

Since, during the establishment of a short stroke with valve 72 maintained closed, helical spring 92 cannot exert enough force on force-transmitting rod 76 to force cam-contacting roller 84 against cam 83, two spiral springs 93 are provided, one on each side of force-transmitting rod 76, with their coils extending through the axial bolt 77 in rotary articulation 78 and with one face engaging counterbearings 94 mounted on force-transmitting rod 76 and the other engaging counterbearings 95 accommodated in the holders 87 that secure the rotary articulations 85 provided for stroke-length setting lever 82.

When cartridge-shaped tappet 73 does not act as a valve-play compensator, the valve play between bearing block 74 and tappet 73 can be compensated by a disk or by a bearing block 74 of sufficient vertical dimension.

Figure 5:
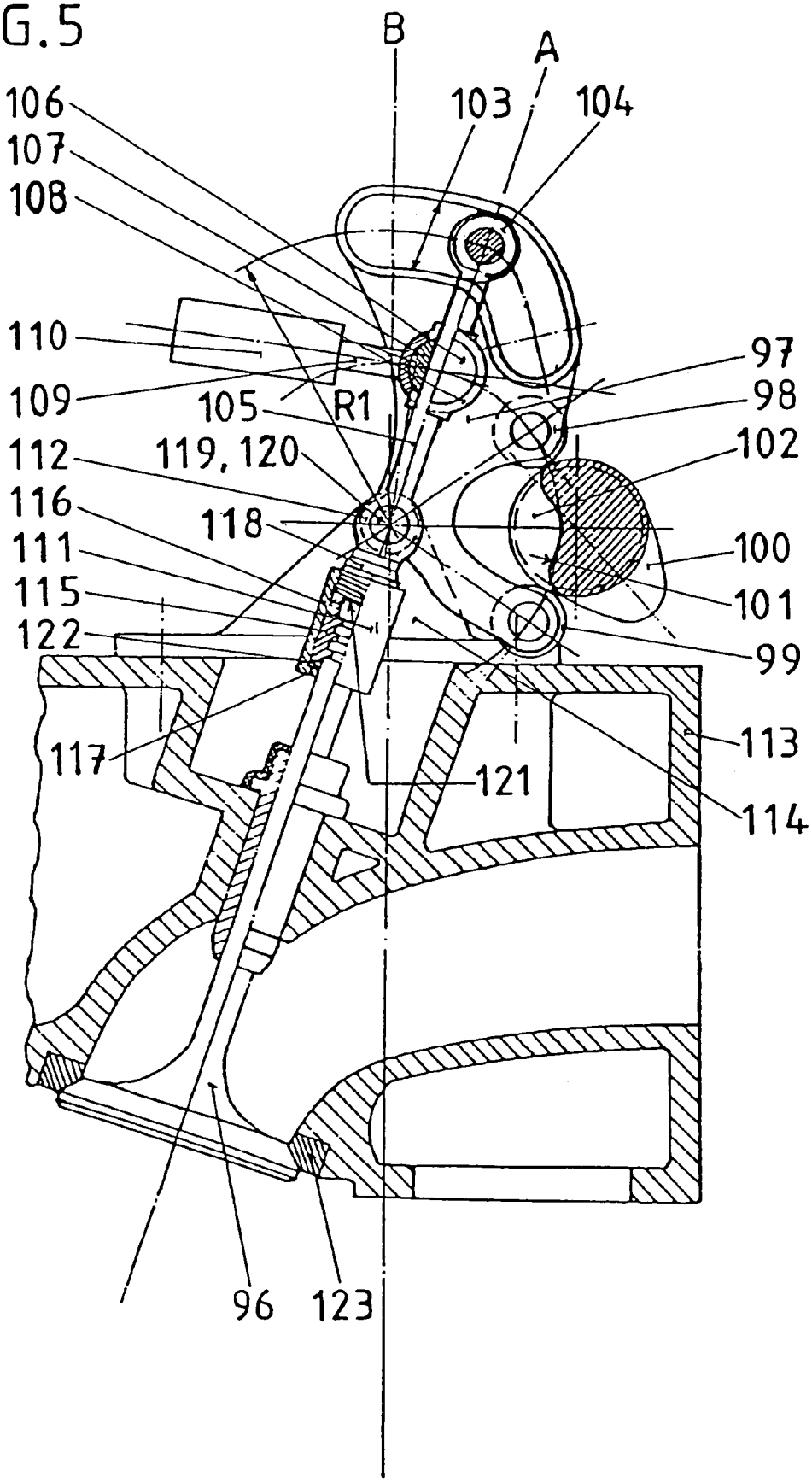
FIG. 5 illustrates desmodromic valve-stroke controls wherein a valve is activated by a rod by way of a rotary articulation, whereby the rod is activated by way of a roller that engages slots in a stroke-length setting lever.

FIG. 5 illustrates desmodromic valve-stroke controls mounted on a cylinder head and employed while a vehicle is in operation to continuously vary the length of the stroke traveled by a valve 96 or to maintain the valve constantly closed. Such controls can be employed to handle several such valves simultaneously instead of just one.

These controls are provided with a rocking lever 97. Mounted stationary on rocking lever 97 are three cam-contacting rollers, specifically two outer cam-contacting rollers 99 and an inner cam contacting roller 98. An elevation on inner cam-contacting roller 98, engages a cam 100 that opens valve 96. A depression on each outer cam-contacting roller 99 engages a cam 101 that closes the valve. Cams 100 and 101 are mounted on a shared camshaft 102.

In both senses of rotation of rocking lever 97, the cam-contacting rollers 98 and 99 thereon are constantly forced into engagement with the cams 100 and 101 mounted on camshaft 102. The cam 101 provided to close valve 96 can accordingly be exploited to open it, and the cam 100 provided to open the valve can be exploited to open it. A cam 101 employed to close valve 96 can alternatively be provided with a depression and located between two cams 100 employed to open valve 96 and provided each with an elevation.

The controls can also include a guide that involves slots. In this event, two slots 103 are accommodated symmetrically in rocking lever 97 equidistant from its axis of rotation. Slots 103 are engaged by rollers 104 mounted on a tension-and-compression transmitting rod 105 positioned between the slots. Tension-and compression transmitting rod 105 travels back and forth but cannot rotate in a transverse bore that extends through a cylinder 107 associated with a rotary articulation 106. The longitudinal axis of cylinder 107 parallels those of cam-contacting rollers 98 and 99. Cylinder 107 rotates around a longitudinal axis inside the housing 108 of rotary articulation 106. Housing 108 is secured to a shaft 109 by way of which it can be displaced by a mechanically or hydraulically driven straight-line guide 110 perpendicular to the axis of rotation of cam-contacting rollers 98 and 99. Displacement by way of an articulated lever driven by an eccentric shaft or crankshaft is alternatively possible. At its upper end, tension-and-compression transmitting rod 105 engages the slots 103 in rocking lever 97 by way of its rollers 104. At its lower end, tension-and-compression transmitting rod 105 activates valve 96 by way of a rotary articulation 111. Rocking lever 97 is provided at each side of tension-and-compression transmitting rod 105 with rotary articulations 112 mounted on holders 114 integrated into a cylinder head 113. The axis of rotation of the rotary articulation 111 mounted on valve 96 simultaneously constitutes the axis of rotation of rotary articulations 112 on rocking lever 97 as long as the valve remains closed. The rotary articulation 111 mounted on valve 96 is fastened to the valve by cylindrical bearing halves 115. Bearing halves 115 are provided with integrated annular beads that fit into incisions in the inner surface of valve 96. Bearing halves 115 can travel back and forth inside a hollow cylinder 116. Hollow cylinder 116 is provided with two caps 117 and 118. Lower cap 117 extends through the shaft of valve 96. Upper cap 118 is provided with an eye 119 that secures an axial bolt 120 provided for tension-and-compression transmitting rod 105. Cap 118 is secured in hollow cylinder 116 by a deformed threaded section. Upper cap 118 rests against a pressure-accommodating surface 121 of valve 96. Accommodated between lower cap 117 and the faces of cylindrical bearing halves 115 are cupsprings 122. Cupsprings 122 are compressed by upper cap 118 as it is screwed in. Cupsprings 122 can be adjusted to maintain total closure of valve 96 over the life of the controls and when the valve impacts too hard against its seat 123.

When camshaft 102 is rotated, the cam-contacting rollers 98 and 99 on rocking lever 97 engage the slots 103 in cams 100 and 101 without the support of valve springs, and the rocking lever 97 will pivot, whereby the rollers 104 at the upper end of tension and-compression transmitting rod 105 will rotate in the rocking lever's slots 103. When valve 96 is intended to remain closed, the rollers 104 on tension-and-compression transmitting rod 105 will be guided by straight-line guide 110 into a position wherein slots 103 travel along the arc of a circle of radius R1, the center of the circle coinciding with the axis of rotation of rocking lever 97. The axis of rotation, in eye 119, of the axial bolt 120 in the rotary articulation 111 associated with valve 96 simultaneously constitutes the axis of rotation of the rotary articulation 112. Consequently, as long as the rollers 104 on tension-and compression transmitting rod 105 are engaging the circular-arc section occupied by slots 103, the valve 96 will be maintained closes. To allow activation of valve 96, the slots 103 are provided with a downward curvature with radii shorter than those of the section employed in maintaining the valve closed. Due to the engagement of the rollers 104 in this range of slots 103 during the pivoting motion of rocking lever 97, the longitudinally displaceable tension-and-compression transmitting rod 105 will swing in both senses around the axis of rotation of the rotary articulation 111 of valve 96 with the rod's longitudinal axis at an acute angle to that of valve 96 and will simultaneously travel back and forth axially. Valve 96 will accordingly be activated by way of rotary articulation 111.

The longitudinal axis of the tension-and-compression transmitting rod 105 in these valve-stroke controls can extend along the longitudinal axis of the closed valve 96 when either a maximal length stroke or a stroke that is ideal for the expected most frequently encountered range of vehicle operation has been established.

In position A, tension-and-compression transmitting rod 105 establishes a maximal-length stroke and, in position B, maintains valve 96 closed.

When, during the rotation of rocking lever 97, tension-and compression transmitting rod 105 shifts out of the position wherein it maintains valve 96 closed and into the position wherein it establishes the maximal-length stroke, the rollers 104 mounted on the rod will begin to engage over a short distance the range of slots 103 that activate valve 96, establishing a short stroke that will briefly open the valve. As rollers 104 further continuously increase their engagement with slots 103, the stroke will simultaneously continuously lengthen, with the length of time it remains open simultaneously increasing.

This embodiment needs no valve springs or recuperating springs.

The tension-and-compression transmitting rod 105 in the desmodromic valve-stroke controls illustrated in FIG. 5 can also be provided with a rotary articulation 112 fastened to cylinder head 113, establishing the stroke by way of an articulated rod. Rotary articulation 112 is mounted on rocking lever 97 and extends through an articulated rod that pivots around camshaft 102. Valve 96 is activated by the rotary articulation 112 mounted on rocking lever 97 by way of a similarly pivoting rotary articulation 111 attached to the valve. An appropriate rotary articulation 111 can be created by allowing axial bolt 120 to rotate around an eccentric that itself rotates in eye 119. The range of slots 103 must in this event be appropriately adapted.

Figure 6:
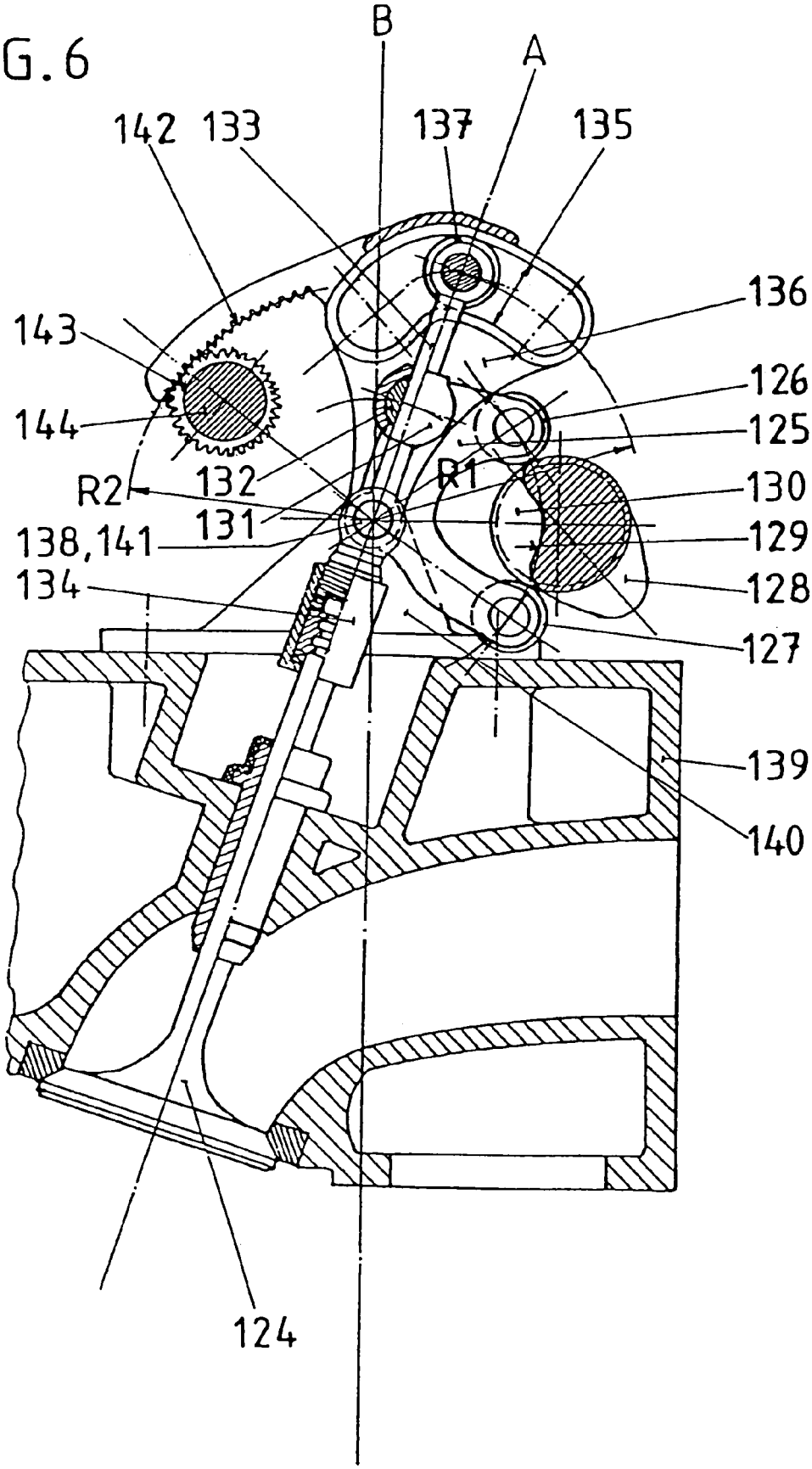
FIG. 6 illustrate desmodromic valve-stroke controls wherein a valve is activated by a rod by way of a rotary articulation, whereby the rod is activated by way of rollers that engage slots in a stroke-length setting lever.

FIG. 6 illustrates desmodromic valve-stroke controls mounted in a cylinder head and employed while a vehicle is in operation to continuously vary the length of the stroke traveled by a valve 124 or to maintain the valve constantly closed. Such controls can be employed to handle several such valves simultaneously instead of just one.

The controls are provided with a rocking lever 125 whereon are mounted stationary three cam-contacting rollers 126 and 127. Inner cam-contacting roller 126 is provided with an elevation that engages a cam 128 that participates in opening valve 124. Each outer cam-contacting roller 127 is provided with a depression that engages a cam 129 that participates in closing the valve. Cams 128 and 129 are mounted on a shred camshaft 130. Rocking lever 125 in both senses of rotation applies constant force to cam-contacting rollers 126 and 127. Mounted on the end of one arm of rocking lever 125 is a housing 131 that constitutes a rotary articulation for a cylinder 132. The longitudinal axis of cylinder 132 parallels the axis of rotation of cam-contacting rollers 126 and 127. Cylinder 132 is provided with a transverse bore, within which a tension-and-compression transmitting rod 133 travels back and forth but cannot rotate. The lower end of tension-and-compression transmitting rod 133 is secured to a rotary articulation 134 connected to valve 124. Tension-and-compression transmitting rod 133 is positioned between two symmetrical slots 135 in a stroke length setting lever 136. The upper end of tension-and-compression transmitting rod 133 is provided with a roller 137 on each side. Rollers 137 engage slots 135 that extend around the axis of rotation of stroke-length setting lever 136 and participate in activating valve 124.

Stroke-length setting lever 136 is U-shaped and encloses rocking lever 125. Rocking lever 125 in turn encloses tension-and-compression transmitting rod 133. Rocking lever 125 and stroke-length setting lever 136 are provided with rotary articulations 138 on each side of tension-and-compression transmitting rod 133. Rotary articulations 138 are mounted on holders 140 fastened to the body of a cylinder head 139. Rocking lever 125 and stroke-length setting lever 136 share axes of rotation and can accordingly be mounted on shared straight axial bolts 141. As long as valve 124 remains closed, the axis of rotation of the rotary articulation 134 mounted on valve 124 simultaneously constitutes the shared axis of rotation of the rotary articulation 138 on rocking lever 125 and stroke-length setting lever 136.

When camshaft 130 is rotated, rocking lever 125 will, due to the engagement of cam-contacting rollers 126 and 127 with cams 128 and 129, execute a pivoting motion around housing 131 without being supported by springs, whereby tension-and-compression transmitting rod 133 will also execute, with its longitudinal axis at an angle that varies slightly with the longitudinal axis of valve 124, a pivoting motion around the axis of rotation of the rotary articulation 134 mounted on the valve. Once valve 124 is being maintained closed, stroke-length setting lever 136 will be shifted until slots 135 are distributed along a circular arc of radius R1 extending out of a center lying along the axis of rotation shared by rocking lever 125 and stroke-length setting lever 136. Since the axis of rotation of the rotary articulation 134 associated with valve 124 will accordingly now coincide with the axis of rotation shared by rocking lever 125 and stroke-length setting lever 136, valve 124 will be maintained closed as long as rollers 137 engage the section of rollers 137 represented by the arc. In order to activate valve 124, the slots 135 in stroke-length setting lever 136 are provided with a downward directed curvature with radii shorter than those associated with the section of slots 135 that participate in maintaining the valve closed. As rocking lever 125 pivots, accordingly, the tension-and-compression transmitting rod 133, which travels back and forth in the rotary articulation [sic] 131 of rocking lever 125, will also execute a pivoting motion, whereupon tension-and-compression transmitting rod 133 will, due to the engagement of its rollers 137 in the range of slots 135 that participate in the activation of valve 124, execute, in addition to its longitudinal motion, a back-and forth motion along the longitudinal axis of valve 124, accordingly activating valve 124 by way of rotary articulation 134.

To allow stroke-length setting lever 136 to carry out its function, it is provided with a cogged section 142 that extends along the arc of a circle of partial radius R2 around the axis of rotation of its rotary articulation 138, whereby cogged section 142 is engaged by a cogwheel 143 mounted on a camshaft 144.

With stroke-length setting lever 136 in position A, the length of the valve stroke will be maximal, and, with the lever in position B, valve 124 will be maintained closed.

When, during the pivoting motion of rocking lever 125, stroke length setting lever 136 shifts out of the position wherein valve 124 is maintained closed and into the position wherein the length of the stroke is maximal, the rollers 137 mounted on tension-and compression transmitting rod 133 will begin to move over a short distance into the range of slots 135 associated with the activation of valve 124, whereupon the valve will be briefly activated with a short stroke length. Subsequently, as rollers 137 increasingly engage the slots 135 in stroke-length setting lever 136, the length of the stroke will also increase continuously, with the length of time the valve will remain open simultaneously increasing.

No valve springs or recuperating springs are necessary.

The tension-and-compression transmitting rod 133 in the desmodromic valve-stroke controls illustrated in FIG. 6 can alternatively be rigidly fastened to rocking lever 125. Rollers 137 can also alternatively be integrated into the body of rocking lever 125, whereby tension-and-compression transmitting rod 133 will not be connected to valve 124, the rotary articulation 138 on rocking lever 125 will extend through an articulated rod that rotates on camshaft 130, and the rotary articulation on rocking lever 125 will activate valve 124 by way of an appropriately pivoting rotary articulation 134 mounted on the valve. Stroke length setting lever 136, however, will still be provided with a rotary articulation 138 rigidly fastened to cylinder head 139. The distribution of slots 135 must accordingly be adapted.

The valve-stroke controls specified with reference to FIGS. 1 through 6 can be employed as a basis for many systems by varying the arrangement of the individual components.

The elbow lever 7 in the valve-stroke controls illustrated in FIG. 1 for example can activate valve 1 by way of its rotary articulation 5, by way of a cartridge-shaped tappet, or even directly, in which case the roller 12 on stroke-length setting lever 13 will be located more or less along the axis of valve 1 while the stroke length is being established and the contact surfaces 10 and 11 of elbow lever 7 will extend more or less perpendicular to the valve's axis. If valve 1 is to be activated directly by elbow lever 7, transverse forces on the valve can be avoided by securing elbow lever 7 laterally against its rotary articulation 5 by means of a linear guide mounted over it, with the longitudinal axis of the guide coinciding with that of valve 1. Such a linear guide can easily be created in the form of a loosely articulated cylinder that travels back and forth inside a hollow cylinder in the vicinity of the rotary articulation 5 on elbow lever 7. To facilitate assembly of the valve-stroke controls to the hollow cylinder, the rotary articulations 15 on stroke length setting lever 13 can be mounted on the hollow cylinder and the latter integrated into the body of cylinder head 17.

Furthermore, the force-transmitting rod 30 in the valve-stroke controls illustrated in FIG. 2 can alternatively activate valve 26 either directly or by way of a rocking lever.

Again, the valve-stroke controls illustrated in FIGS. 3 and 4 can alternatively activate valves 49 and 72 either directly or by way of a rocking lever.

Finally, the valve-stroke controls illustrated in FIGS. 5 and 6 can activate valves 96 and 124 by way of a rocking lever or cartridge-shaped tappet, in which case the valves must be forced against the lever or tappet when the valves are opening or closing.

The invention claimed is:

1. Valve-stroke control apparatus for continuously varying the stroke of a valve in an engine, and for selectively maintaining said valve closed, while said engine is in operation, said apparatus comprising a force-transmitting rod driven by a cam, which causes said force transmitting rod to pivot about an articulation point, via a cam-contact roller; wherein:

a rocking lever, which activated said valve, is articulate at said articulation point on a first end of said force transmitting rod;

a second end of said force-transmitting rod has an additional roller that engages a contact surface of a stroke-length setting lever;

said contact surface extends substantially transversely to a longitudinal axis of said stroke-length setting lever;

said contact surface has a contour such that pivoting of the force-transmitting rod by said cam and said cam contact roller causes movement between said contact surface and said additional roller, which movement in turn causes said force-transmitting rod be displaced longitudinally in a direction of movement of said force transmitting rod that is associated with opening the valve; and a displacement is introduced by way of said articulation point into said rocking lever.

2. The valve-stroke control apparatus according to claim 1, wherein:

a first portion of the contact surface of the stroke-length setting lever, which is associated with maintaining the valve closed, extends along the arc of a circle around an axis of rotation of rotary articulation point that is mounted on the stroke-length setting lever and connected to a cylinder head of said engine by holders; and the rotary articulation point mounted on the stroke-length setting lever share an axis of rotation with a rotary articulation shared by the rocking lever and the force-transmitting rod, whenever the valve remains closed.

3. The valve stroke control apparatus according to claim 1, wherein said stroke-length setting lever has arc-shaped gearing extending about a rotational axis of a rotational link; and a gear mounted on a camshaft engages with said arc-shaped gearing.

* * * * *